United States Patent [19]

Petri

[11] 3,991,674

[45] Nov. 16, 1976

[54] DAMPENING APPARATUS FOR A LITHOGRAPH OFFSET PRINTING PLATE

[76] Inventor: Nello J. Petri, 2140 Jones St., San Francisco, Calif. 94133

[22] Filed: Sept. 11, 1973

[21] Appl. No.: 396,206

Related U.S. Application Data

[63] Continuation-in-part of Ser. No. 126,082, March 19, 1971, abandoned, and a continuation-in-part of Ser. No. 274,648, July 24, 1972, abandoned.

[52] U.S. Cl. ..... 101/148; 101/349

[51] Int. Cl.[2] ..... B41F 7/26; B41F 7/36; B41F 7/40

[58] Field of Search ..... 101/147, 148, 348–352, 101/205–209

[56] References Cited

UNITED STATES PATENTS

| | | | |
|---|---|---|---|
| 1,341,692 | 6/1920 | White | 101/349 |
| 1,955,752 | 4/1934 | Lamatsch | 101/349 |
| 3,168,037 | 2/1965 | Dahlgren | 101/451 X |
| 3,283,707 | 11/1966 | Greubel et al. | 101/352 X |
| 3,433,155 | 3/1969 | Norton | 101/148 |
| 3,673,959 | 7/1972 | Jezuit | 101/148 |
| 3,688,694 | 9/1972 | Preuss | 101/148 |
| 3,701,316 | 10/1972 | Sylvester | 101/148 |
| 3,749,011 | 7/1973 | Abendroth et al. | 101/148 |
| 3,769,909 | 11/1973 | Fugman | 101/148 |

*Primary Examiner*—J. Reed Fisher
*Attorney, Agent, or Firm*—Gordon Wood

[57] ABSTRACT

A dampening apparatus for a lithographic press in which a train of rollers conducts dampening fluid from a pan to the form roller or applicator roller of the press that is in contact with the printing plate. The fluid is conducted from a pan roller to a metering roller and then to a transfer roller which is in rolling engagement with and rotating at the same peripheral speed as the form roller. Variation in the amount of dampening fluid which is transferred to the form roller is achieved by driving the pan roller and intermediate roller directly from a separate source of power and permitting the remaining rollers of the train to be driven from the printing plate or inking rollers. By varying the speed of rotation of the pan roller and intermediate roller the amount of fluid transferred to the form roller may be varied to the end that the exact amount of water required by the form roller may be provided.

1 Claim, 3 Drawing Figures

FIG. 3
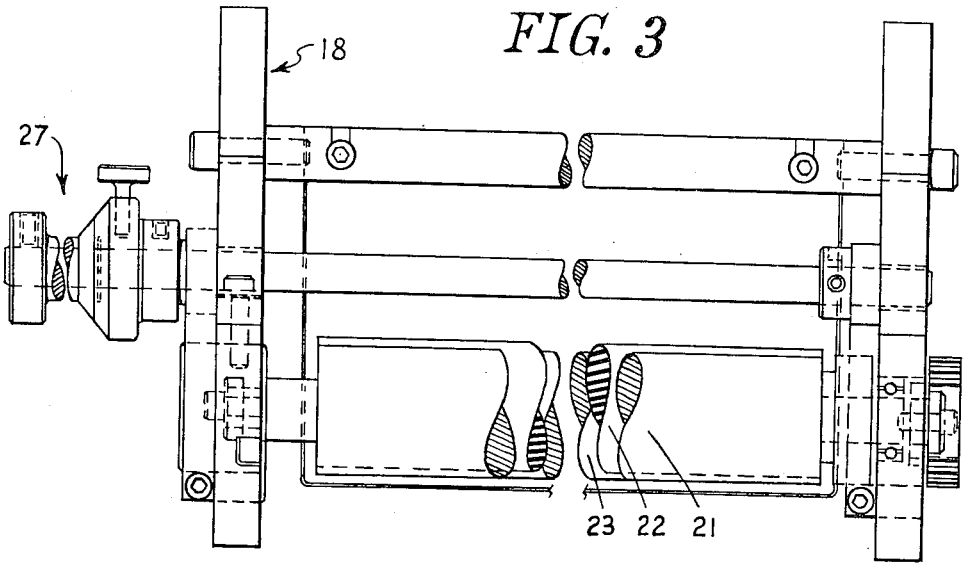
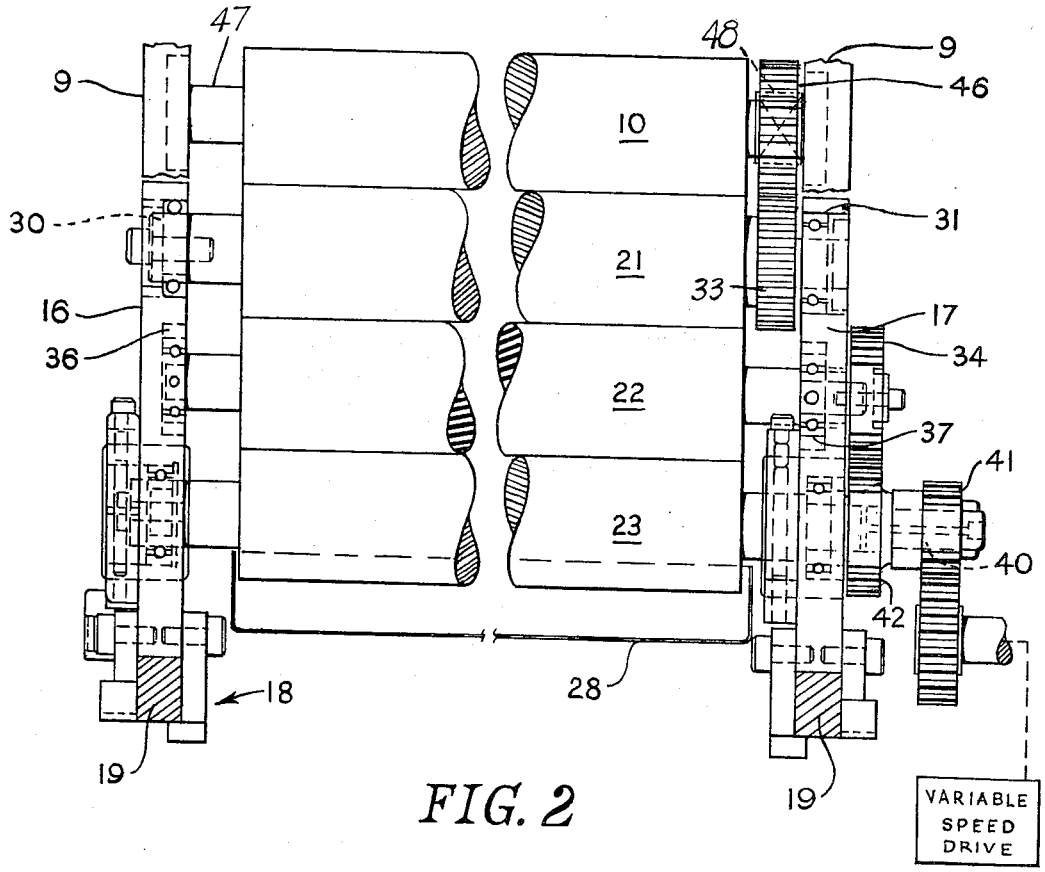
FIG. 2

DAMPENING APPARATUS FOR A LITHOGRAPH OFFSET PRINTING PLATE

This application is a continuation-in-part of application Ser. No. 126,082 filed Mar. 19, 1971, now abandoned, and application Ser. No. 274,648 filed July 24, 1972, now abandoned.

This invention relates to lithographic offset printing and particularly to apparatus for applying dampening fluid to the printing plate. In most lithographic presses the form roller is in rolling engagement with both an ink roller and the plate. The transfer roller which transfers water to the form roller is in turn in rolling engagement with a pan roller which picks up the dampening fluid from a pan in which it rotates.

In the prior art type of system to which the present invention pertains, means is provided for rotating the form roller and the transfer roller at different speeds to control the amount of fluid transferred to the form roller. According to the prior art, the speed of the transfer roller may be controlled from its own power source or rotation may be initiated through the pan roller. Certain disadvantages result from the above described arrangement. First, if the form roller is even slightly out of round, the use of a variable speed transfer roller, relying as it does on "scraping" action, results in different densities of fluid being impressed on the form roller thus altering the printing condition at different points on the printing plate. Second, the principle employed in varying the rate of fluid feed by varying the speed of the transfer roller relative to the form roller depends upon providing a head or reservoir of fluid at the nip between the pan roller and the transfer roller. The provision of such a bead is undesirable since it does not permit accurate control for the amount of fluid being fed to the form roller. Furthermore, such a bead tends to run across the length of the rollers in the event that a partial web is being printed.

The main object of the present invention is to provide an apparatus for transferring dampening fluid to the form roller with a high degree of uniformity and at the same time provide an accurate means for varying the amount of fluid to suit the particular conditions that are present.

It has been found that the most effective method of varying the supply of dampening fluid to the form roller is to vary directly the amount of fluid removed from the pan by varying the speed of the pan roller and an intermediate metering roller in rolling engagement therewith. By the present invention the rollers in the fluid dampening train except the pan roller and such intermediate roller run at the same surface speed so that no reliance is had on varying the speed of the transfer roller thus obviating the above noted undesirable results. By the present invention, the additional intermediate roller in the train is interposed between the transfer roller and the pan roller and has the effect of smoothening out the film of fluid which is ultimately transferred to the plate. The addition of said intermediate roller permits the provision of an accurate thickness of film of fluid to be transferred from said intermediate roller to the transfer roller, thence to the form roller.

Other objects and advantages will be apparent from the following specification and from the drawings:

FIG. 2 is a vertical side elevation of the apparatus of FIG. 1 with portions of the length of the rollers broken away to permit a larger scale.

FIG. 3 is a plan view of the apparatus.

Figure 1:
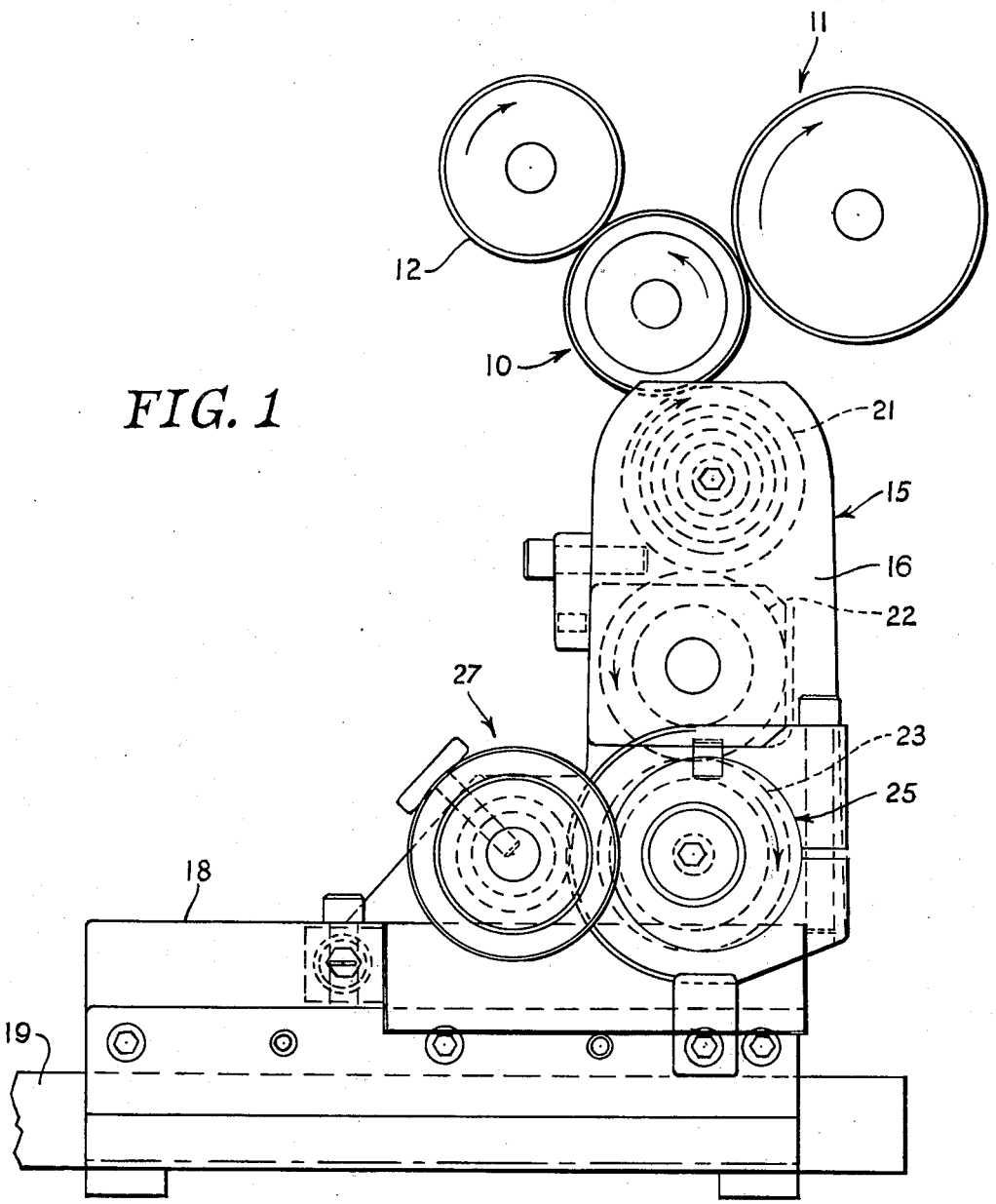
FIG. 1 is an end elevation of the frame on which the rollers which constitute the apparatus of the present invention are mounted.

In detail, and first with reference to FIG. 1, a form roller generally designated 10 is rotatably supported on a suitable frame indicated at 9 in FIG. 2 and is in ink transfer relation with an independently driven plate 11 which is also supported for rotation in the same frame 9. An inking roller such as that indicated at 12 is in rolling engagement with the form roller 10 and is gear driven from the plate 11 so that the relative rotary speeds of the inking roller 12 and plate 11 remain the same at all times. The structure thus far referred to is conventional and is representative of the prior art.

The rollers of the present invention are rotatably supported within a frame generally designated 15 which includes a pair of opposed bearing supporting plates 16, 17 and a base generally designated 18. Means (not shown) is provided for translating the base 18 along support shafts 19 so that the train of rollers may be moved into and out of engagement with the form roller 10. The uppermost roller rotatably supported in frame 15 is the transfer roller 21 which, during printing, is in rotatable engagement with the periphery of the form roller 10. Along its lower side the transfer roller 21 is in peripheral engagement with a rubber covered resilient roller 22 which is interposed between the transfer roller 21 and the pan roller 23. The support of the pan roller 23 is similar to that as shown in U.S. Patent No. 3,552,311 and includes an eccentric member generally designated 25 which may be actuated by an adjustable device 27 for the purpose of varying the pressure between the pan roller 23 and the intermediate rubber roller 22. Said device 27, as shown in said Patent No. 3,552,311, also includes means for tilting the pan roller 23 relative to the metering roller 22. Such tilting adjustment is not claimed herein but permits the width of the fluid film to be adjusted to suit different widths of webs. Preferably the pan roller 23 is of chrome as is the transfer roller 21. However the intermediate rubber roller 22 is resilient so that the same may be indented by the pan roller 23 to different degrees as desired. Fluid from pan 28 is transferred to pan roller 23 as the latter rotates.

As best seen in FIG. 2 the transfer roller 21 is rotatably supported at its opposite ends in bearings 30, 31 respectively so as to be in rolling engagement with intermediate roller 22. Roller 22 is rotatably supported in bearings 36, 37 respectively in side plates 16, 17. The bearings 30, 31 of transfer roller 21 and bearings 36, 37 of the intermediate roller 22 are fixedly secured in place so that the center line distance between rollers 21, 22 is not readily varied. However, as noted above, the center line distance between roller 22 and 23 and the relative angularity thereof may be varied by means of the eccentric 25 and the adjustable device 27.

The shaft 40 of pan roller 23 is provided at its outer end with a gear 41 which may be connected to a suitable variable speed driving means, indicated schematically in FIG. 2, so that the speed of rotation of the pan roller 23 may be varied. Also provided on shaft 40 is a gear 42 in mesh with a gear 34 on the shaft of the intermediate roller 22. By this structure the gear train comprising rollers 22, 23 may be driven at a predetermined rate of speed from the variable speed gear when said rollers are disconnected from form roller 10. By permitting the speed of rotation of shaft 40 to be varied, the amount of fluid transferred to the intermediate metering roller 22 is varied. However, no variation in the equal peripheral speeds of form roller 10, and transfer roller 21, is permitted so that the film of the fluid transferred to the plate from roller 10 may be made equal to the amount transferred from transfer roller 21 to the form roller 10. This is accomplished by predetermining the outside diameter of form roller 10 so that when the same is slightly compressed by chrome transfer roller 21 when the two rollers are in fluid transfer relation, then the peripheral speeds of rollers 10, 21 are exactly the same.

The form roller 10 is provided with a gear 46 which is in mesh with gear 33 of transfer roller 21. The gear 46 is connected to shaft 47 of form roller 10 through an overrunning clutch 48 which permits the form roller to gear drive the transfer roller and at the same time prevents the transfer roller from gear driving the form roller. By this structure the form roller 10 drives the transfer roller 21 at the same peripheral speed without slippage, which is essential to achieving the objects of the present invention.

By the above described structure it will be apparent that form roller 10 is frictionally driven by inking roller 12 and plate cylinder 11 so that slippage occurs between the form roller and the plate cylinder. For this reason the speed of form roller 10 can never be accurately predetermined. However no relative movement between any of said rollers is relied on to vary the amount of fluid being transferred to the plate 11. However, relative surface movement between intermediate metering roller 22 and transfer roller 21 is permitted and is in fact relied on to vary the amount of fluid transferred to plate 11. By the above described arrangement it will be apparent that, in operation, the roller 22 is ordinarily driven by gear 42 and pan roller 23 is separately driven from its own variable speed drive. In other words, intermediate roller 22 normally has a different surface speed from transfer roller 21. By speeding up pan roller 23 the amount of fluid transferred to roller 22 and thence to the plate 11 may be increased. However, when frame 15 is backed slightly away from form roller 10, the gears 46, 33 remain in engagement but the surfaces of rollers 10, 21 separate so that no dampening fluid is transferred to roller 10. This is desirable because the rollers 21, 22, 23 should be rotated and should remain damp when the form roller 10 is slowed down or stopped. In this manner dampening fluid is instantly available when the press is started up again.

When the press is stopped and the rollers supported on frame 15 continue to rotate by virtue of the variable speed drive, then gear 46 is driven by gear 33 but rotation is not imparted to shaft 47 of roller 10 because of the presence of overrunning clutch 48.

It is emphasized that since inking roller 12 and plate 11 are geared together, the relative speed between the two is constant. However, since the form roller 10 is driven from said roller 12 and plate 11 by friction, the peripheral speed of said form roller is never known and cannot be accurately predetermined but by the present invention, is the same peripheral speed as transfer roller 21 because the latter is driven by said form roller 10 through gears.

The detailed description given above of the preferred form of the invention should not be taken as restrictive, as it will be apparent that various modifications in design may be resorted to by those skilled in the art without departing from the scope of the following claims.

I claim:

1. In a device for applying dampening fluid to the plate of a lithographic press:

an inking roller power driven from said plate, a fluid transfer roller, a form roller peripherally driven by friction from said inking roller and in rolling engagement with said transfer roller, a reservoir for fluid, a pan roller adapted to receive fluid from said reservoir, and an intermediate roller interposed between and in rolling engagement with said pan roller and said transfer roller, independent driving means for driving said pan roller independently of said plate, form and transfer rollers, a pair of gears on said form and transfer rollers respectively for driving said transfer roller from said form roller at the same surface speed, and an overrunning clutch interposed between said form and transfer rollers to permit said form roller to gear drive said transfer roller and preventing said transfer roller from gear driving said form roller.

* * * * *